US006286752B1

(12) United States Patent
Heyer

(10) Patent No.: US 6,286,752 B1
(45) Date of Patent: Sep. 11, 2001

(54) FOLDER FOR PAPERS

(75) Inventor: Hans Heyer, Wuppertal (DE)

(73) Assignee: Mappei-Organisationsmittel GmbH, Wuppertal (DE)

( * ) Notice: Subject to any disclaimer, the term of this patent is extended or adjusted under 35 U.S.C. 154(b) by 0 days.

(21) Appl. No.: 09/194,483

(22) PCT Filed: May 16, 1997

(86) PCT No.: PCT/EP97/02515

§ 371 Date: Sep. 8, 1999

§ 102(e) Date: Sep. 8, 1999

(87) PCT Pub. No.: WO97/44199

PCT Pub. Date: Nov. 27, 1997

(30) Foreign Application Priority Data

May 22, 1996 (DE) ..... 196 20 506

(51) Int. Cl.[7] ..... B65D 27/08; B65D 85/30; B65D 37/00; B42D 1/00

(52) U.S. Cl. ..... 229/67.3; 229/67.1; 229/67.4; 281/15.1; 281/45; 281/46; 281/48; 281/3.1; 281/51

(58) Field of Search ..... 229/67.1, 67.3, 229/67.4, 928; 281/15.1, 45, 48, 51, 3.1, 46; 150/142, 144

(56) References Cited

U.S. PATENT DOCUMENTS

| | | | | |
|---|---|---|---|---|
| 984,482 | * | 2/1911 | Howell et al. | 229/67.1 |
| 2,252,177 | * | 8/1941 | Heyer | 150/142 |
| 4,331,290 | * | 5/1982 | Benham | 229/72 |
| 5,797,630 | * | 8/1998 | Conley, Jr. | 281/15.1 |
| 5,803,250 | * | 9/1998 | Mori | 229/72 |

FOREIGN PATENT DOCUMENTS

| | | |
|---|---|---|
| 671229 | 2/1939 | (DE) . |
| 3028799 | 3/1982 | (DE) . |
| 382179 | 9/1923 | (EP) . |
| 0292412 | 11/1988 | (EP) . |

* cited by examiner

*Primary Examiner*—A. L. Wellington
*Assistant Examiner*—Mark Henderson
(74) *Attorney, Agent, or Firm*—Martin A. Farber

(57) ABSTRACT

A folder for papers (S), comprising a cover (1) and a base (2) operatively joined together by a back (3), wherein the back (3) is adjustable in width (y) to accommodate a height of a stack of papers, wherein the back (3) extends on a base side into a tongue (4} said tongue being insertable and movable in a pocket (5), said tongue constituting an insertable tongue said pocket_being joined to the base (2), and movement of the insertable tongue (4) in the pocket (5) being limited by a stop.

19 Claims, 17 Drawing Sheets

8
9
G
II
10
2
11
G
8
9

A
6
4
I
3
13
14
1
14
13

10
11
2
8
9
8'
7
14
13
1
3
12
6
A
G
4
5
x
z
y
S 10
11
12
9
8
7
14
13
1
y
8'
8'
8'
8'
6
A
G
2
5
4
9
8
3
S
14
13

1
14
13
14
13
II
3
4
6
A

FOLDER FOR PAPERS

FIELD AND BACKGROUND OF THE INVENTION

The invention relates to a folder for papers, having a cover and a base joined together by a back, wherein the back can be adjusted in its width to accommodate the height of a stack of papers, to which end the back extends on the base side into an insertable tongue which is movable in a pocket which is joined to the base.

A folder of this kind is known from DE-PS 671 229. A stack of papers is held in the region of the back by an adaptedly exposable adhesive layer. The insertable tongue which is accommodated in freely displaceable manner is disposed, inside the pocket, between two leaf springs, so that a certain resistance is offered to its movability. Restraining means such as these are expensive and complicate initial assembly by insertion or, respectively, renewed insertion, if the insertable tongue should have slipped out again nonetheless.

Through EP-PS 382 179, there exists the proposal of forming the back of a letter file proportionally from an angled portion of the cover and from a portion of the base angled in opposite direction, the portions overlapping one another and thus facilitating a coexpansion of the back. However, this requires a technique which is complex in terms of connection, with elongated holes and bolts in the form of staples reaching through these holes.

SUMMARY OF THE INVENTION

It is an object of the invention to develop a folder for papers of the introductory-mentioned type, which is simply manufactured and easily used.

According to the invention, a folder for papers is provided of the introductory-mentioned type, which is of increased usefulness. The expensive matching of materials is also dispensed with. On the contrary, there results a grading-free and therefore environmentally friendly disposal. Concretely, it is provided that the movement of the insertable tongue in the pocket be limited by a stop. The limiting can be felt distinctly. This therefore ends the uncertainty arising in practice in regard to a mere restraining of the displacing movement. The corresponding means to this end is simple, in that the insertable tongue has a flap portion as stopper for the purpose of forming the stop. The flap portion can be taken directly into account when cutting out the corresponding component jointly forming the folder. It then proves to be an advantageous measure in terms of assembly for the flap portion to overlap the top side of the pocket. For this purpose, the pocket is open through in the direction of insertion. The overlap at the same time permits a visual control as to whether the stopping means are present or properly arranged. The pocket also can be realised from integral portions of the corresponding component, in this case the base, to be more precise in such a way that the pocket is formed from a folding tab joined to the base. This folding tab is simply tucked in transverse to the path of displacement of the insertable tongue. The flap portion is then turned down to overlap the edge of the folding tab. A folding tab such as this may lie over the entire distance extending in folding direction; developing upon this, however, there is also an advantageous solution to the effect that the pocket is formed of two oppositely directed, that is to say towards one another, folding tabs joined to the base. This produces an even more stable solution, to be more precise as a result of the adjoining regions of such folding tabs which are now doubly present at the flap joint end. The maximum path of displacement may also be made shorter step-by-step, in that the flap portion is appropriately prepared for the purpose of changing the length by overfolding. Folds such as these arranged in parallel are previously known per se from the conventional loose-leaf binder. Furthermore, an advantageous feature of the invention consists in a thin edge of the folding tab, facing away from the back, cooperating as counter-stop with the flap portion. A more far-reaching graduation than by means of closely adjoining parallel folds is achieved in that the folding tab is longitudinally divided, with formation of part folding tabs, for the purpose of changing the counter-stop. In other words, the tucked-in folding tab, or both folding tabs tucked in directed towards one another, or an alternating sequence of several folding tabs, provide practically ladder-like counter-stops disposed transverse to the direction of extension, likewise realised from the thin edges, facing away from the back, of such part folding tabs. Furthermore, it is favourable for the base, facing away from the back, to continue into a tuck-in wall entirely or partially overlapping the pocket. This holds the sheets forming the withdrawal limiting device one above the other and, which may be of benefit in certain cases, prevents direct contact of the filed material or papers with the aforesaid means. In addition, binding tongues may be provided on the tuck-in wall etc.

In a multi-compartment folder for papers, an advantageous construction is produced by stacked folders for papers according to one or more of the preceding features in only one direction. As the element joining the individual folders for papers, there serves here also an open through pocket to be overlapped by a flap portion or of flap portions. A particularly advantageous solution in this regard is achieved by a pocket respectively joining, with limited displacement, the base of a first folder for papers and the cover of a second folder for papers, etc. A solution which is even of independent significance is provided in that the pocket is formed from an intermediate blank having the folding tab or respectively, the folding tabs and in that the covers and bases respectively bound to one another by the pocket have the flap portions. This withdrawal limiting device may be realised both by a combined, astraddle-like overlapping of both flap portions at a counter-stop, or else also with use of separate counter-stops, which are provided, as explained, in the case of the construction of part folding tabs. It then proves to be of further advantage for the intermediate blank also to have a tuck-in wall extending beyond its back. This wall may have supporting strips for the lateral supporting of the accommodated filing material.

BRIEF DESCRIPTION OF THE DRAWINGS

With the above and other objects and advantages in view, the present invention will become more clearly understood in connection with the detailed description of preferred embodiments, when considered with the accompanying drawings of which FIG. 1 the folder for papers according to the invention in elevation, according to the first embodiment by way of example, FIG. 2 the same in side view, FIG. 3 a blank forming the base and the pocket of the folder, FIG. 4 a blank of the folder providing the cover and the insertable tongue, FIG. 5 the completed folder for papers, opened out, with minimum exposed width of its back, FIG. 6 a representation corresponding to FIG. 5, with maximum exposed width of the back, FIG. 7 a variant of the blank forming the base and the pocket, also usable as link for the purpose of constructing a multi-compartment folder for papers, FIG. 8 a differently shaped blank providing cover and insertable tongue plus stop, FIG. 9 a blank likewise providing cover, insertable tongue plus stop, usable in conjunction with the blank according to FIG. 7, FIG. 10 an intermediate blank corresponding to FIG. 7, as pocket-forming connecting portion for the multi-compartment folder for papers, FIG. 11 an assembled multi-compartment folder for papers in perspective representation, closed, as a second embodiment by way of example, FIG. 12 the same with view into the opened first folder of the multi-compartment folder for papers, to be more precise in unextended condition with regard to the back, FIG. 13 the same in extended position, FIG. 14 the multi-compartment folder for papers with view into the second opened folder, unextended, FIG. 15 the same in extended position, FIG. 16 the multi-compartment folder for papers with view into the third opened folder, unextended, FIG. 17 the same in extended position, FIG. 18 the multi-compartment folder for papers with view into the fourth opened folder, unextended, FIG. 19 the same in extended position, FIG. 20 the multi-compartment folder for papers with view into the fifth opened folder, FIG. 21 the same in closed condition, to be more precise viewed towards the back side, FIG. 22 a view of the multi-compartment folder for papers, unfilled and with shingled structure as a result of maximum releasing of the extension, FIG. 23 a most extensively schematicised side view of same, illustrating the function of the connecting portions, FIG. 24 a similar side view, the back of one of the bundled folders for papers having transformed into the extended condition as a result of increased filling and FIG. 25 in perspective view, the connecting portion formed from the intermediate blank, on its own.

DETAILED DESCRIPTION OF THE PREFERRED EMBODIMENTS

Figure 2:
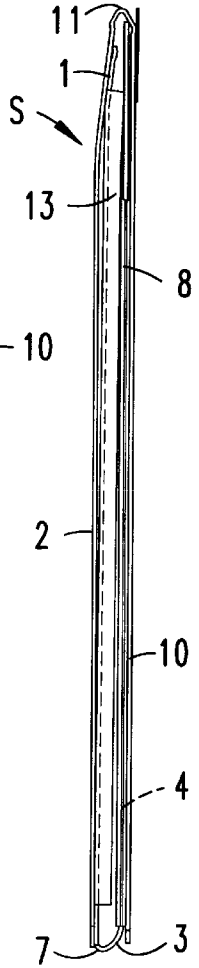
Figure 1:
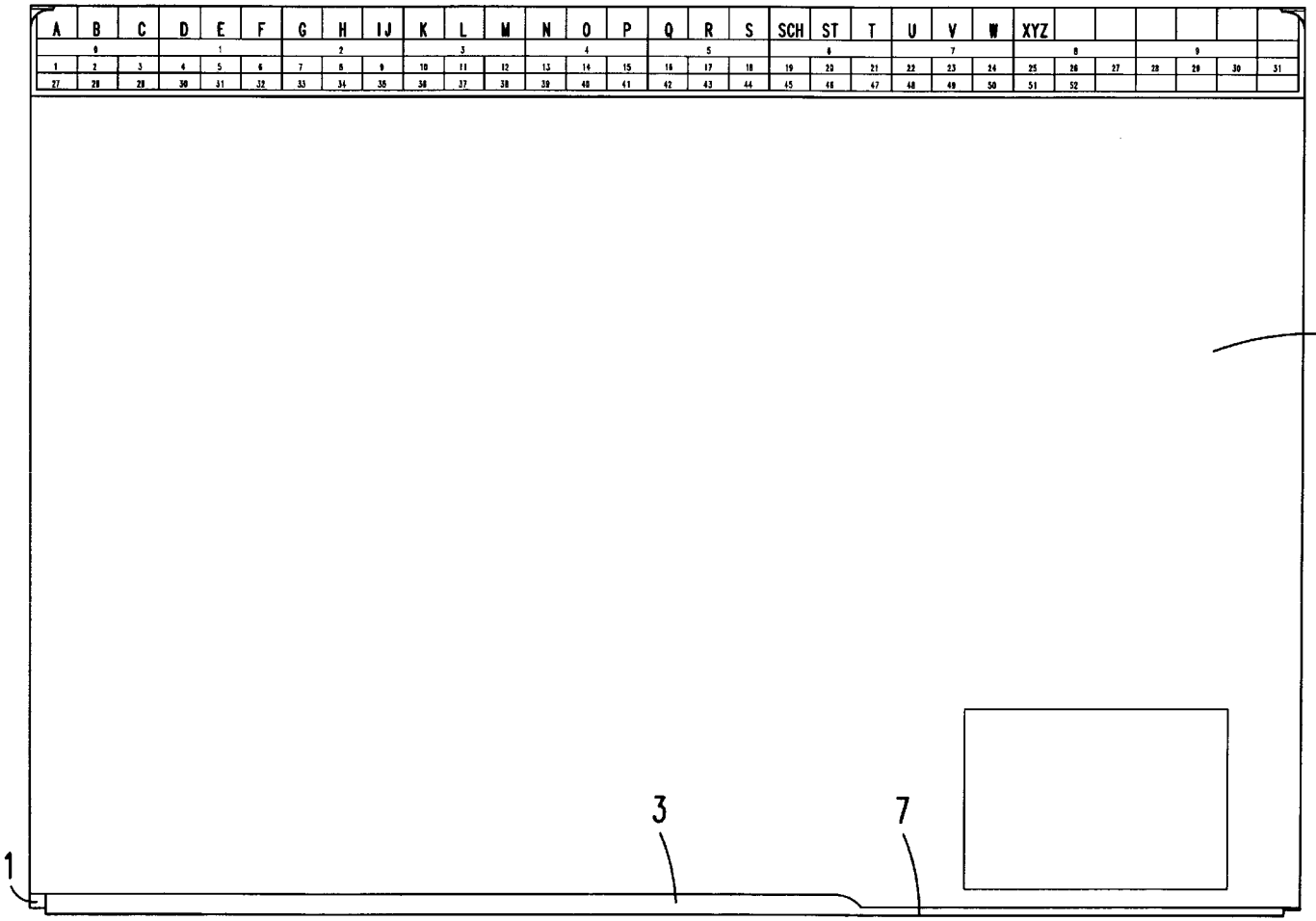

The portfolio-like loose-leaf folder which can fold open and closed and is designated throughout the following as a folder for papers S, comprises a cover 1 and a base 2. Both the aforementioned portions are of approximately the same surface area and have a rectangular plan. They are composed preferably of cardboard material; however, plastic film or thinner paper may also be used.

Cover 1 and base 2 are connected by means of a back 3. The back can change in width with regard to increasing or decreasing height of the stack of papers or respectively, filing material. Cover 1 and base 2 are preserved with regard to surface area in this connection. An insertable tongue 4 connected to the back 3 holds the corresponding reserve ready for extension of the back 3. The insertable tongue behaves as a so-called stopper in a pocket 5 of the folder for papers S which is constructed in at least two portions for this purpose. The withdrawal travel of the insertable tongue 4 is about three cm, for example. With regard to the pocket 5, however, there may also be used a separate flat tubular portion. A C-shaped profile will already suffice under certain circumstances. The end regions of the C-shaped arms form groove-like shafts. Pockets such as these may be securely adjoined by stapling, gluing or the like.

Figure 4:
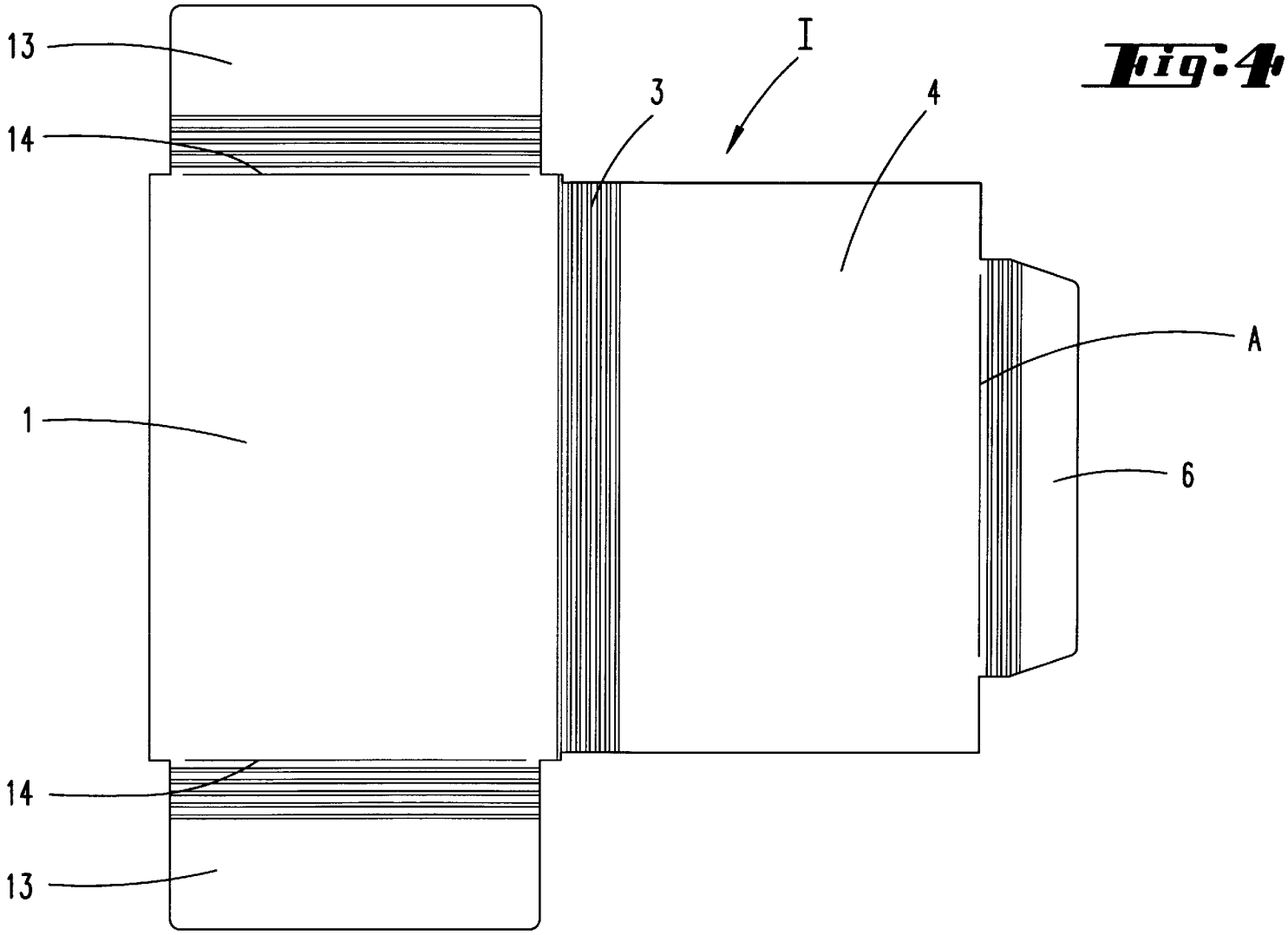

Cover 1, back 3 and insertable tongue 4 are made of a common first blank I in substantially T-shaped form. This blank is represented in isolation in FIG. 4. In the aforementioned sequence of the functional portions 1, 3 and 4, there finally adjoins a flap portion 6. The flap portion functions as a stop A limiting the path of displacement x, thus as a so-called stopper. In both end positions, a defined direction of displacement is provided. At least, however, withdrawal is blocked. The maximum path of displacement x represented in FIG. 5 between pocket 5 and insertable tongue 4 corresponds substantially to the chosen maximum obtainable or respectively usable width y of the back 3. As can be seen from FIG. 6, the stop A is formed by the base of the fold joint of the flap portion 6 turned down in direction of the back 3. The directions of displacement (back and forth) are indicated by arrows.

Figure 3:
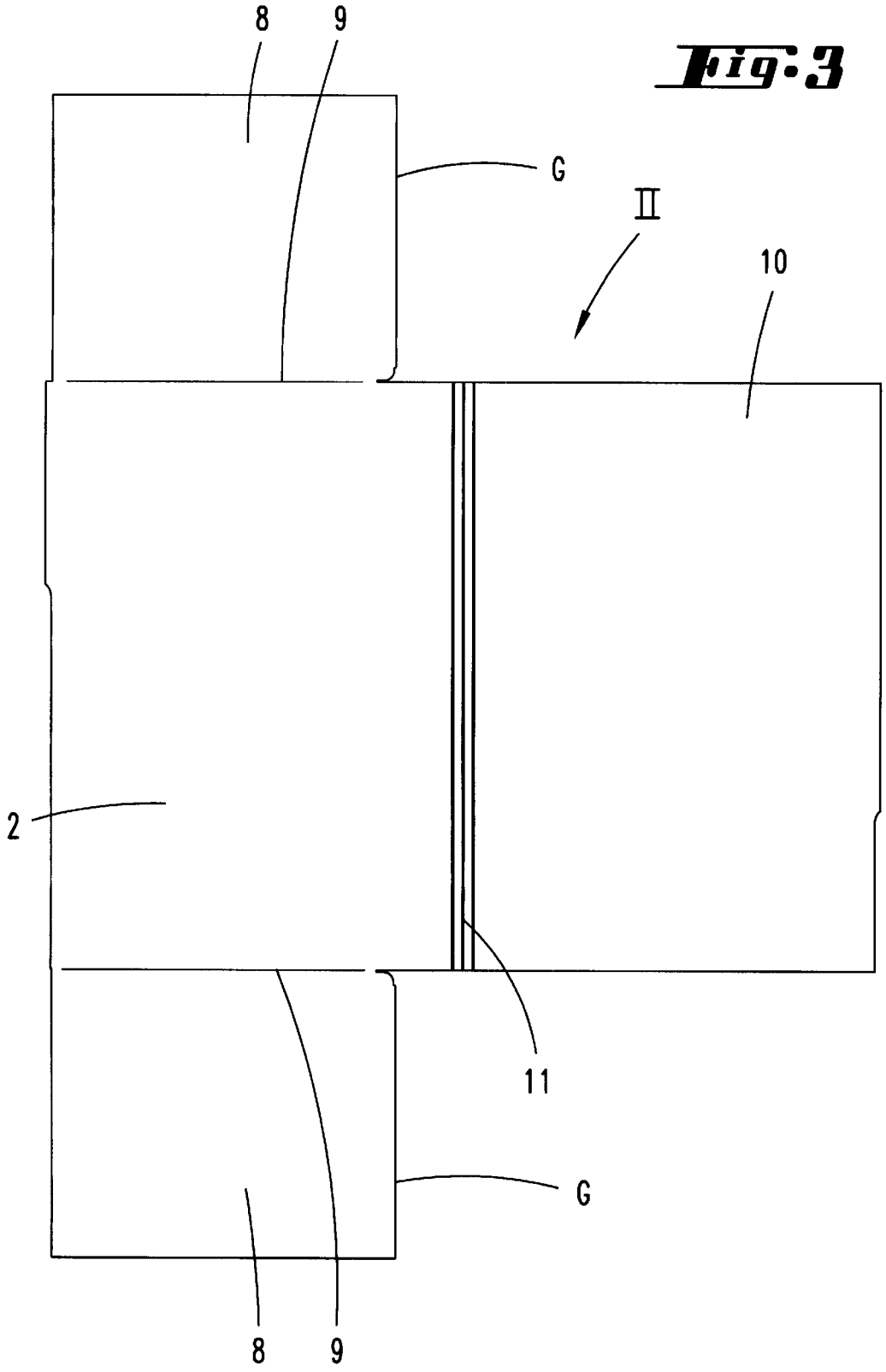
Figure 5:
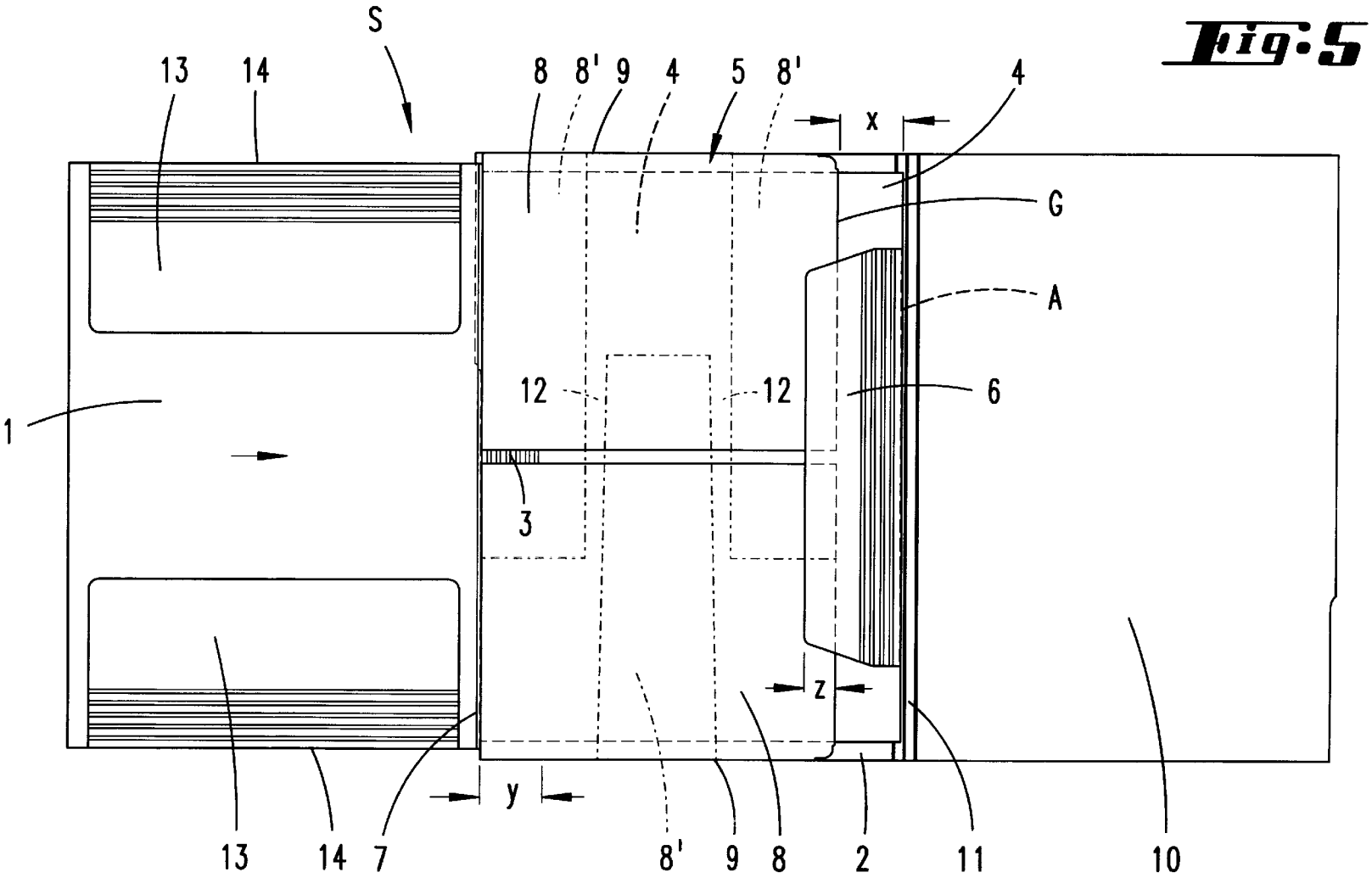

This withdrawal limiting device obtains its corresponding counterstay from the aforementioned pocket 5, which is a constituent part of a second blank, designated with II, represented by way of example in FIG. 3. Its flap portion 6 overlaps the pocket 5 at, the top end (see FIG. 6). This overlap is still provided even when, as illustrated in FIG. 5, the entire width y of the back 3 is inserted into the pocket 5, so that the back 3 now provides there practically only a hinge fold 7 which is close to the cover. The overlap is designated with z (compare FIG. 5). Back 3 and flap portion 6 can, as is evident, be folded closely parallel.

A structurally particularly simple solution consists in the insertable tongue 4 being made smaller and being guided displaceably as a parallel strip tongue in one or preferably two transverse slots of the base 2. The word "transverse" means: transverse to the direction of displacement x. After insertion, the free end of the insertable tongue 4, hence the flap portion 6, is folded over the thin edge, facing away from the back, of the transverse slot in question. There is thus produced, here also, an effective stopper. The flap portion 6 may be folded through to the outside. This variant is not represented, being easily imaginable. The base 2 can thus remain in the usual format, that is to say, for example, DIN A 4. The pocket is integrated in especially material-saving manner here. Generally, the pocket 5 may also be formed optionally on the cover 1 or on the base 2.

Also the second blank II is basically of T-shaped plan, the T-stem forming, with regard to surface area, the aforementioned base 2 and the T-arms there forming folding tabs 8, which are tucked into the inside of the folder at right angles to the direction of displacement of the insertable tongue 4. The folding tabs end there with front end directed towards front end. Instead of as represented and preferred, however, the pocket 5 may also be produced from only one folding tab 8 extending from the base 2. The folding seams in this connection bear the reference number 9. The thin edges of the folding tabs 8, remote from the back, function as counter-stop G for A.

Figure 6:
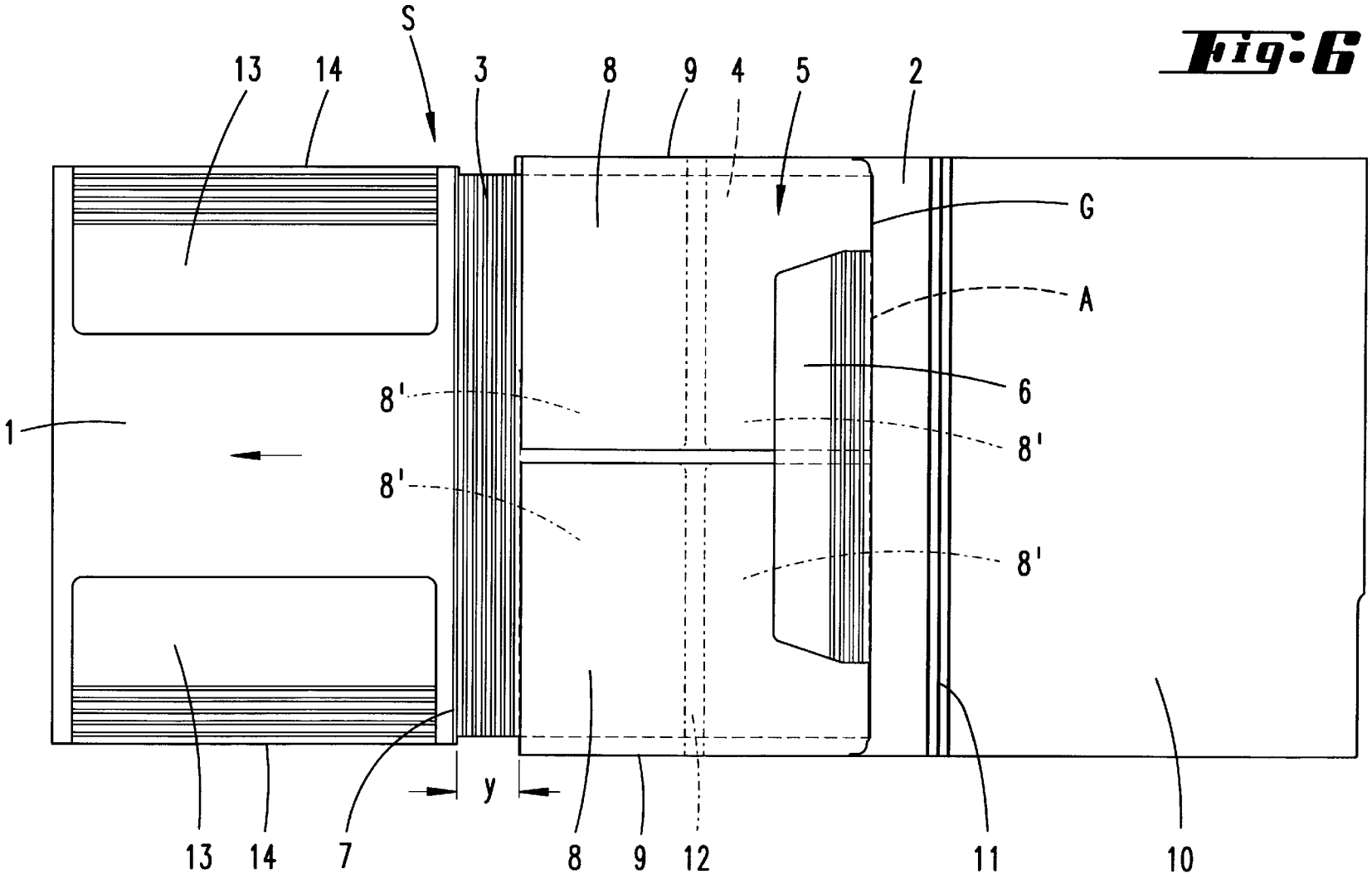

As can be taken from FIG. 3 and also FIG. 6 for example, the base 2 continues on, in the direction of displacement of the insertable tongue 4, into a tuck-in wall 10, extending the length of the T-stem so to speak. The tuck-in wall 10 begins at a fold line 11 of the base 2. Cover 1, base 2 and tuck-in wall 10 are approximately identical in surface area.

So as also to be able to vary the width y of the back 3 step-wise, for example, both the back 3 and also the flap portion 6 are prepared by closely adjacent foldings which are manifest from the drawings, so that the thin edges, facing away from the back, of the folding tab 8 or respectively of the folding tabs 8 come into operation against these also as counter-stop G of stop A.

The counter-stop G may also be formed in a region of the pocket 5 which is closer to the back 3. For this purpose, the folding tabs 8 merely need to be cut back correspondingly. On this account, the thin edge forming* the counter-stop G may be displaced more in the direction of the back 3. In addition, a stepped arrangement of counter-stops G is possible, by slitting the folding tabs 8 at a spacing. A slot such as this is reproduced by way of example in FIG. 6 and designated with 12. The folding tab 8 longitudinally divided in this manner with formation of part folding tabs 8', 8' could also provide stepped counter-stops arranged in ladder-like manner. FIG. 5 shows, in dash-dot type lines, a second variant of the part folding tab 8', to be more precise aligned alternatingly in opposite directions and clearly overlapping one another side-by-side.

Folding tabs 8 or respectively 8' such as these can furthermore be realised as narrow strips, for example fitted on the inside with a surface fastener. In this connection, the edge portion of the insertable tongue 4 would carry the counter-fastener. What is in mind here is a so-called hook-and-loop type fastener.

The variable displacement region may advantageously be covered by the aforementioned tuck-in wall 10, so that the papers or respectively filing material, not represented, are accommodated divided off therefrom.

In the interest of a lateral positional securing of the papers of the folder S used in landscape format, there serve supporting strips 13 which can be tucked in. These supporting strips extend via fold seams 14 into the cover 1 or respectively extend outward from same. The start of the supporting strips 13, at the cover edge end, passes from the aforementioned fold seam 14 into a folding, so that these supporting strips 13 may also coexpand or respectively be reduced again with reference to the height of the stack of papers.

Figure 11:
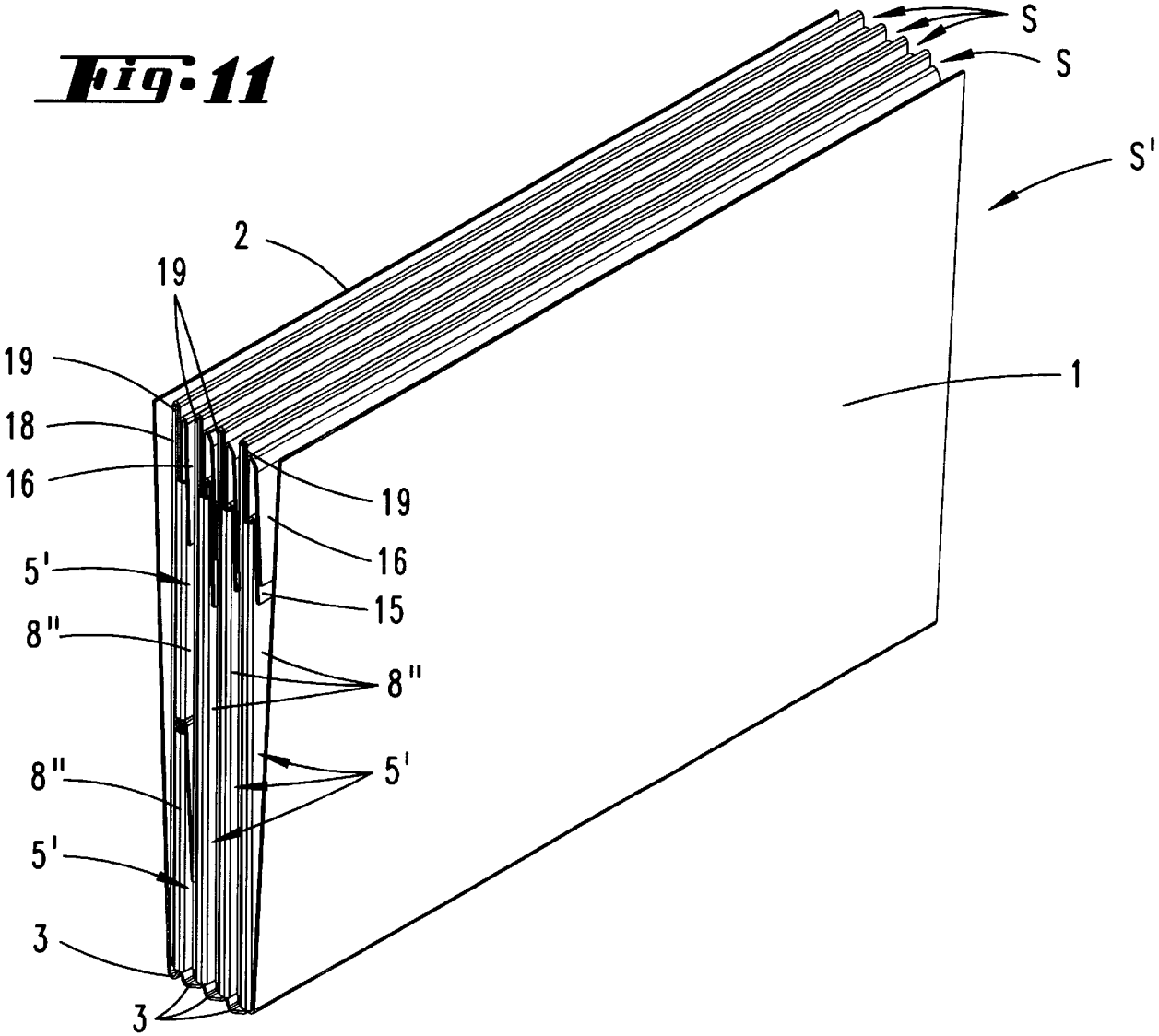
Figure 22:
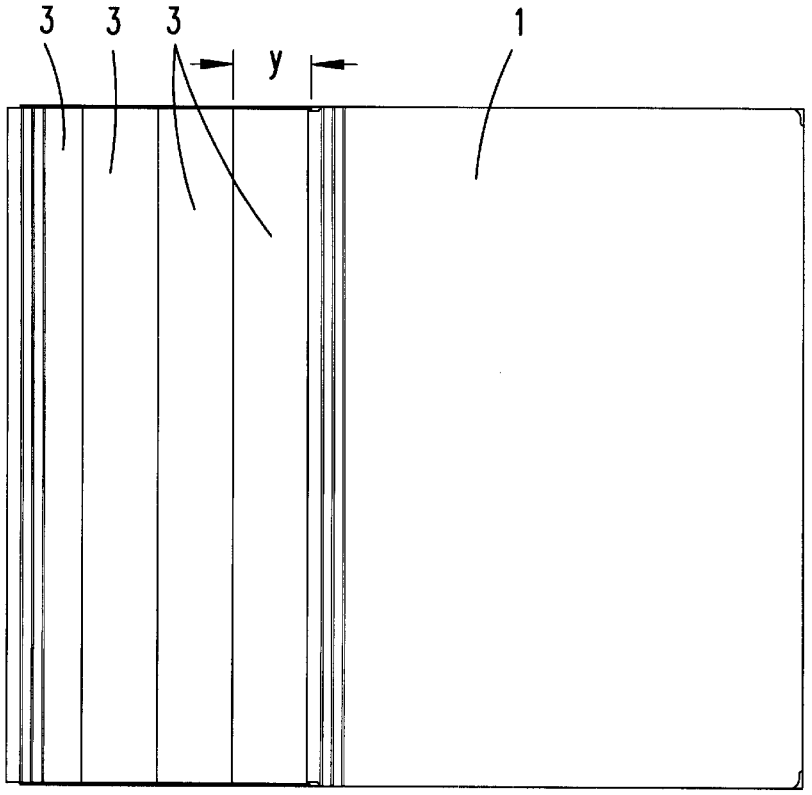

The multi-compartment folder for papers S', embodying the second embodiment (compare, for example, FIG. 11), is of identical construction in principle. The reference numbers are applied appropriately, in part without repetition of wording. In this case, individual folders for papers S are added to form a kind of extending portfolio, combined one above the other for the purpose, there being provided one overall back obtainable from many backs 3. The disposition one above the other is clearly to be seen from FIGS. 22 to 24. Apart from the displaceability limited by stops discussed in detail above and also provided here, the individual folders for papers S are bound to one another by means of a connecting portion. Reference may be made to FIG. 11.

Figure 7:
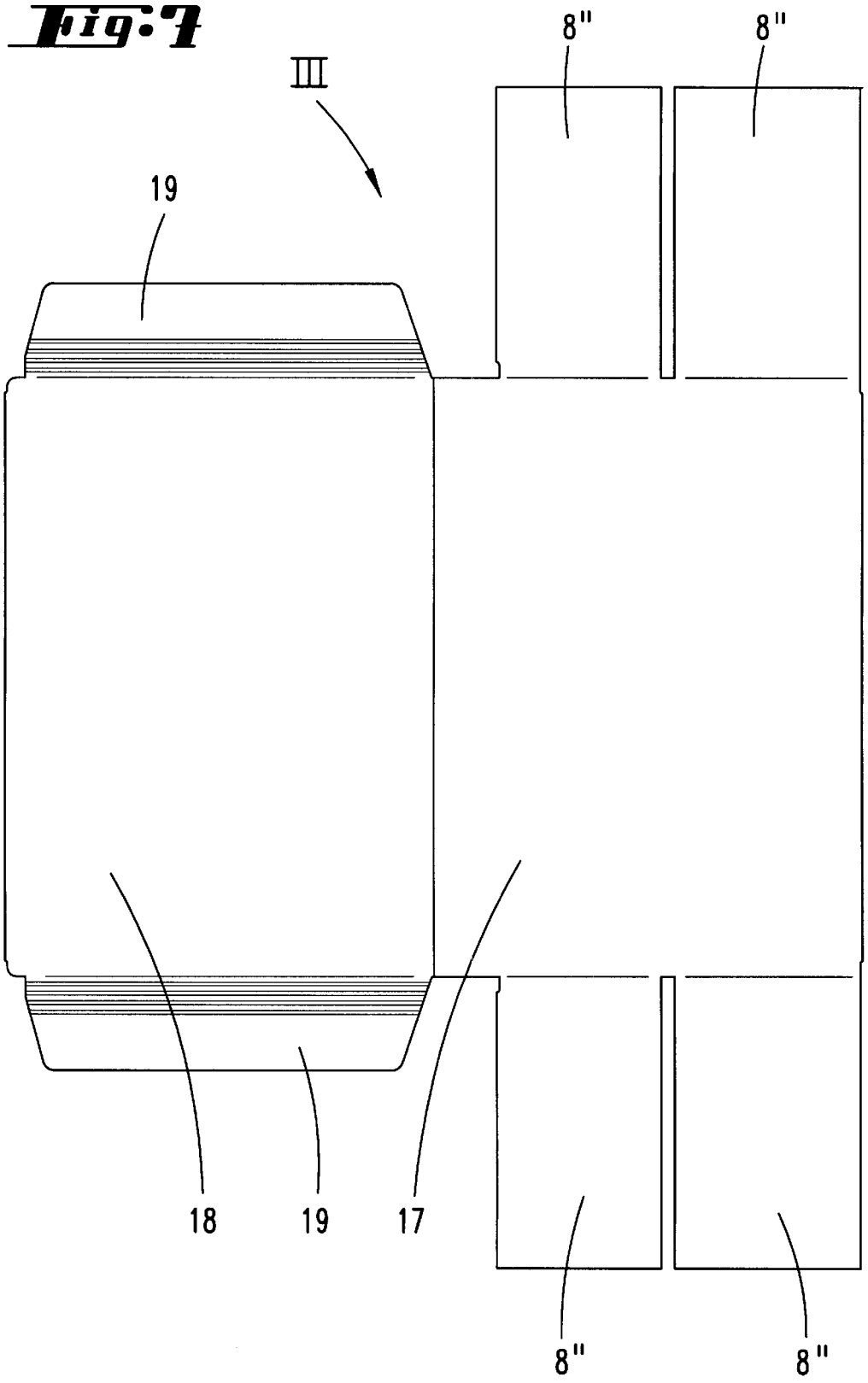
Figure 8:
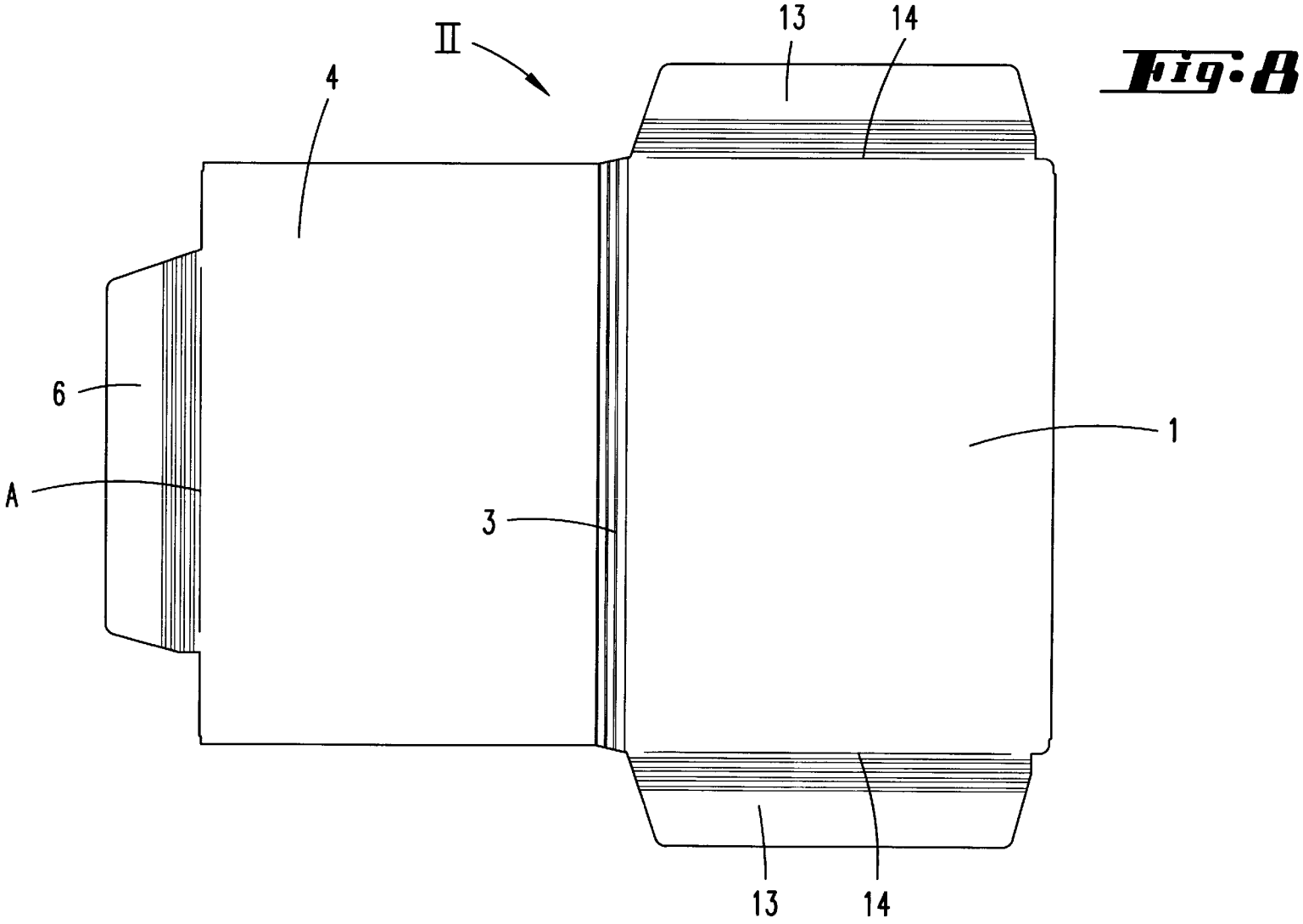
Figure 10:
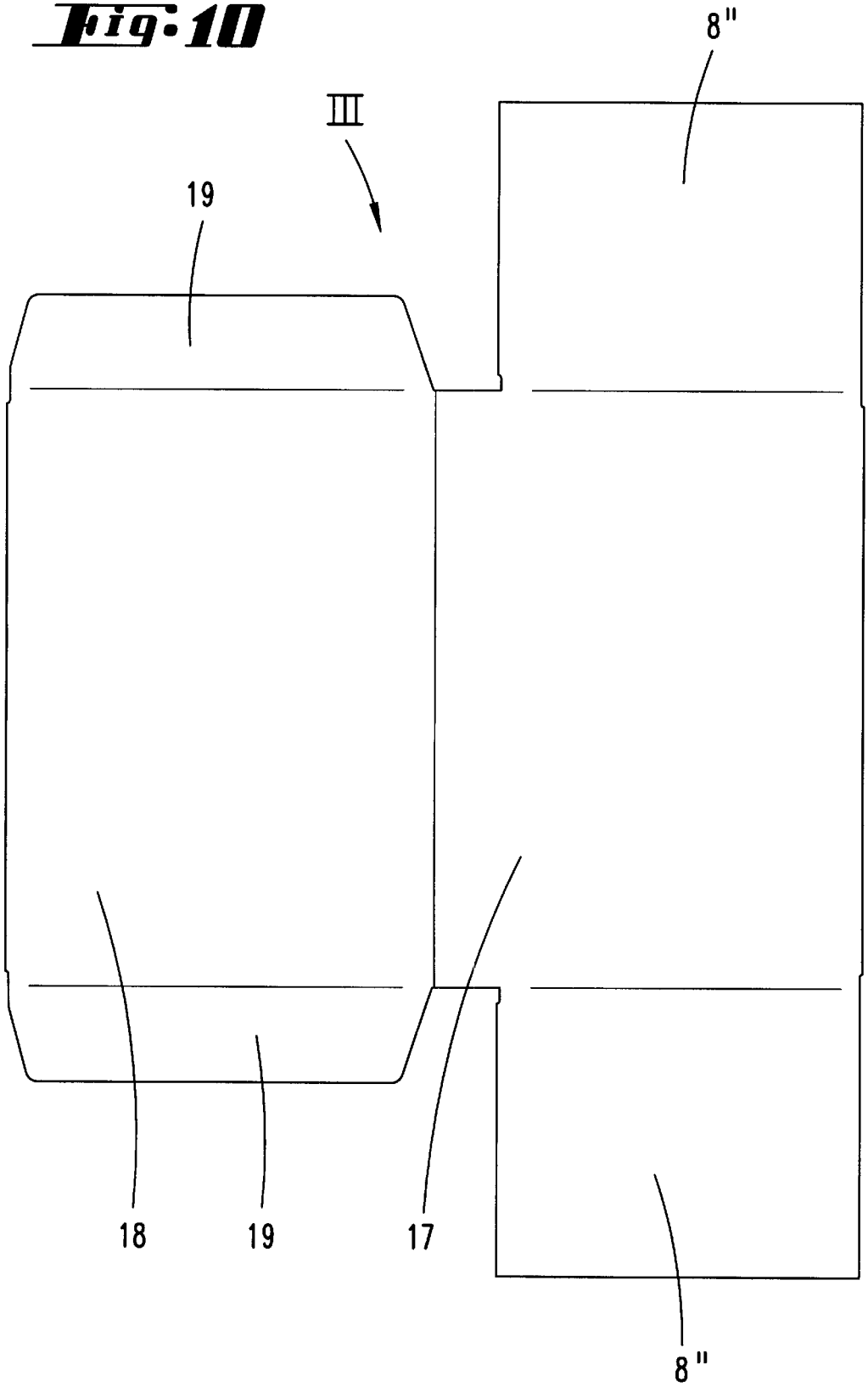
Figure 25:
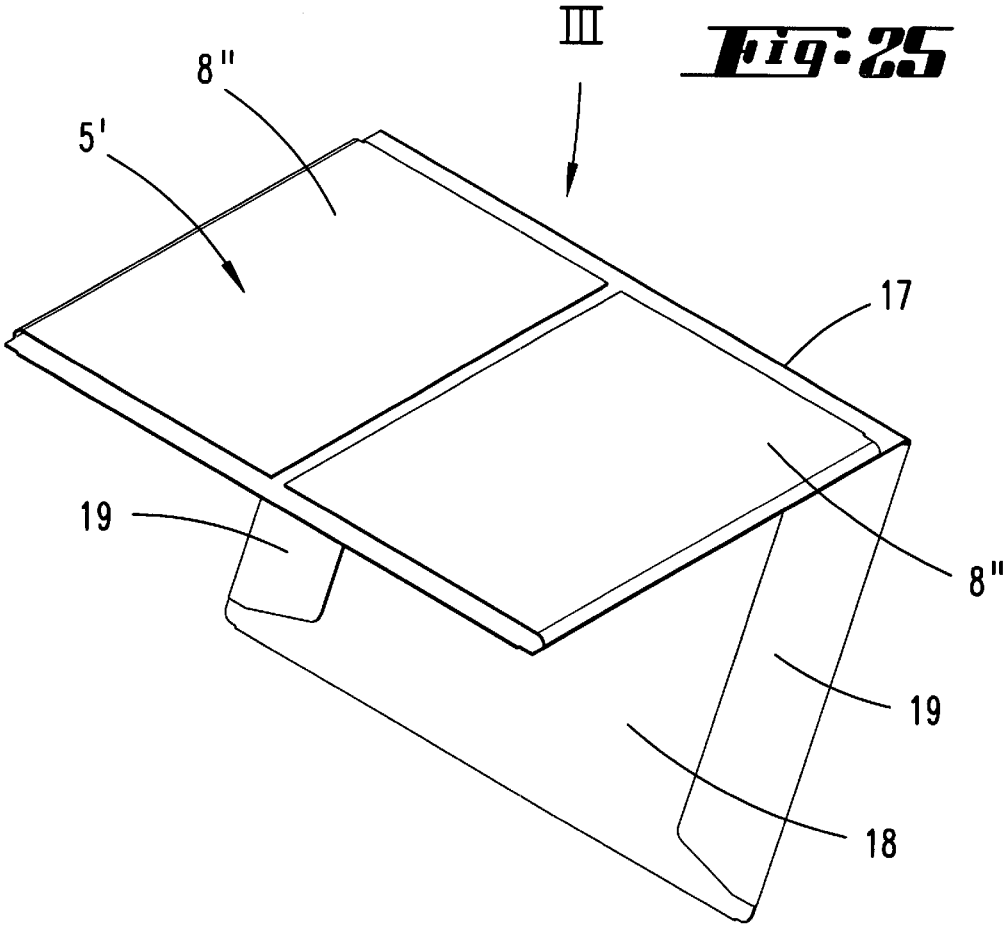

With regard to the connecting portion, there is question of a pocket-forming intermediate blank III, as emerges mainly from FIG. 10 and in modification also from FIG. 7. In folded position prepared for mounting, the blank (III) is to be seen in perspective representation in FIG. 25.

Its pocket, designated here with 5', comprises two folding tabs 8", which are folded towards one another tranverse to the direction of displacement (compare arrows in FIGS. 5 and 6). These folding tabs 8", 8" result from the T-shaped form of the intermediate blank III also provided here correspondingly. There is thus produced a kind of tube section or respectively a pocket 5' open throughout for insertion. The pocket accommodates the base 2 of a first folder for papers S and the cover 1 of a second folder for papers S. These portions are introduced displaceably, limited by stops and respectively limited in terms of withdrawal, together or independently of one another in the tube section or respectively in the pocket 5'. In this connection, the base 2 and cover 1 introduced through the pocket 5' and displaceable therein, limited by a stop, each continue here into a flap portion 15 and 16 respectively. The latter fulfil the function of the flap portion 6 and that of binding the folders S to one another. In addition, in regard to maximum exposed width y of the respective back 3, they assume a closely nestled, astraddle-like position (compare FIG. 23). The flap portion 15 originating from the base 2 comes, with the base of its fold, as counter-stop G, against the stop A formed by the corresponding thin edge of the folding tabs 8" of the pocket 5'. When a folder S is moved out to the left, the flap portions 15, 16 still remain in overlap in a remaining section. A separation of the folders for papers S thus combined is possible only with destruction of the corresponding displacement limiting means.

Figure 23:
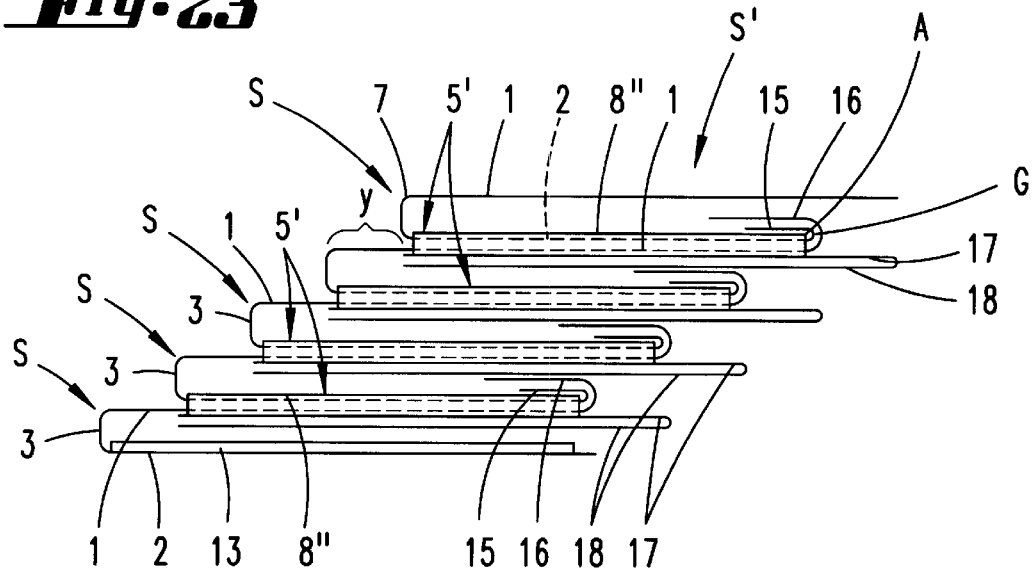

As is likewise to be taken from FIG. 23, the intermediate blank III has a tuck-in wall 18 extending beyond its base* 17. This wall has foldable supporting strips 19, left out of the representation, which undertake a function such as is explained with reference to the supporting strips 13 of the cover 1.

Figure 24:
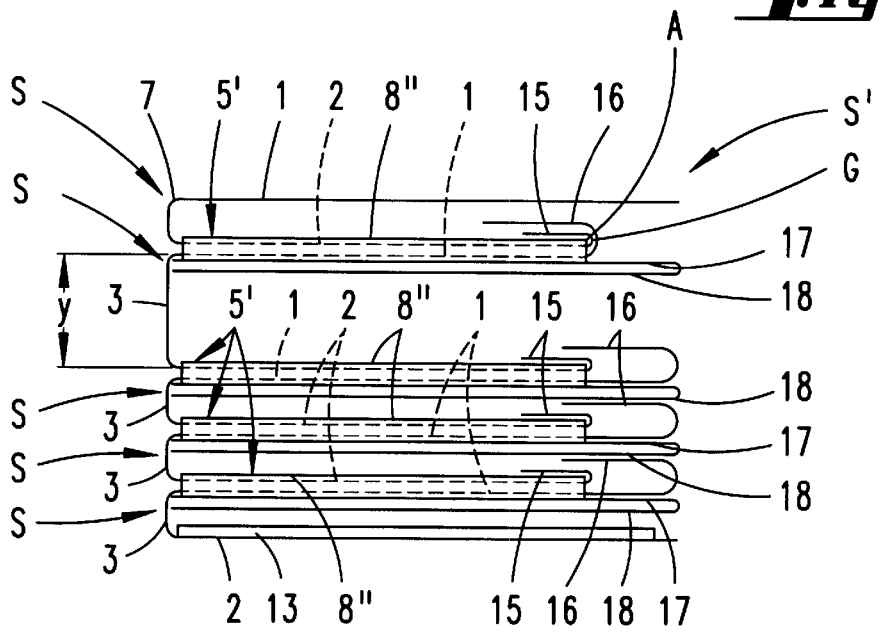

FIG. 24 shows one of the folders for papers S with back 3 transformed into a greater width y, enlarging the quire spacing from cover to base. By this means there is provided a degree of accommodation of this folder S substantially meeting the height of the stack concerned.

Figure 12:
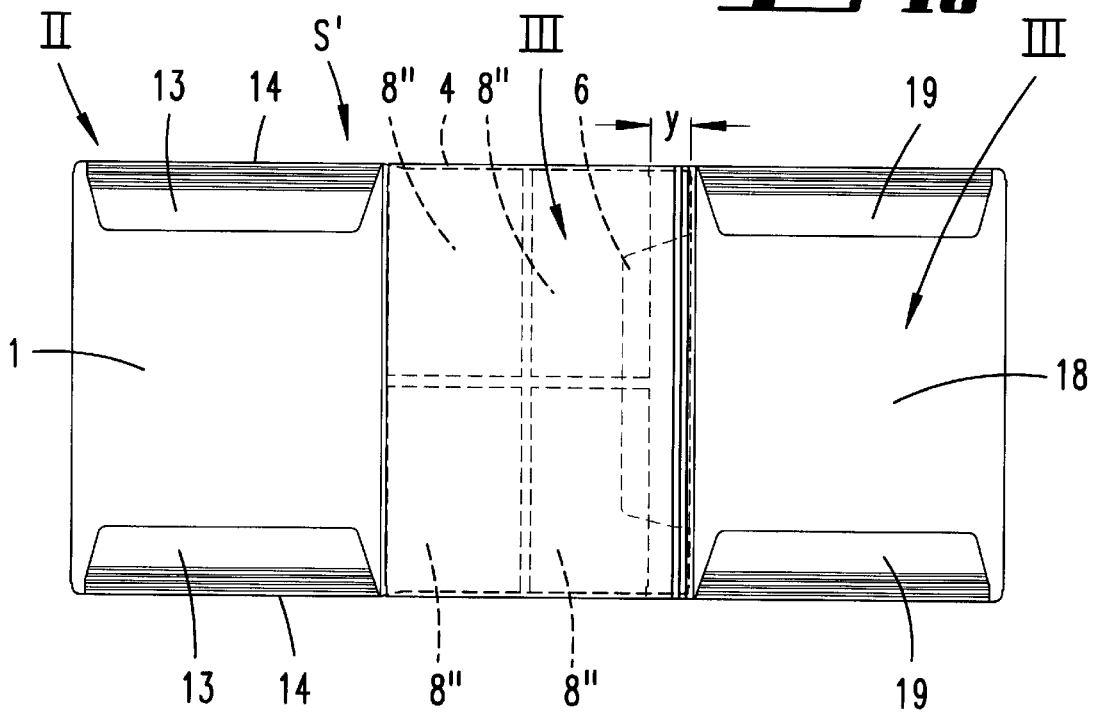
Figure 13:
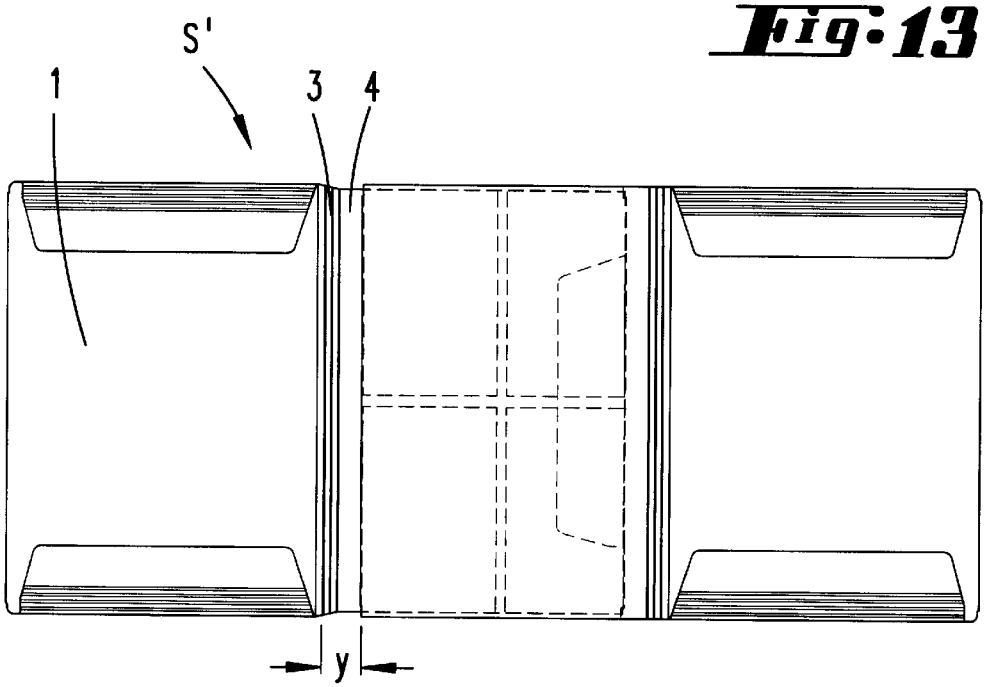
Figure 21:
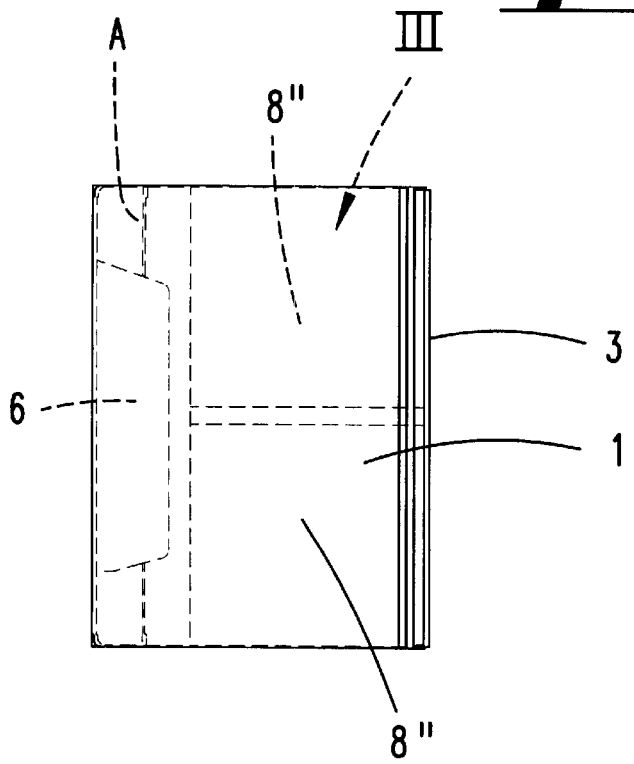

Beginning with FIG. 12 there emerges a study of unfolding from initial folding open of the multi-compartment folder for papers S' shown there, up to the end or respectively the closing of this folder (FIG. 21). The elements explained above recur therein. The reference numbers are applied in accordance with the text. FIGS. 12, 14, 16, 18 show the minimum useable width of the back 3, just precisely in the sense of providing the fold seam 7, which width occurs or respectively suffices only in regard to minimally filled loose-leaf folders. FIGS. 13, 15, 17 and 19, in contrast, indicate the maximum width y of the back 3, it being naturally understandable that by use of the ladder-like stops A, there may be achieved an even far greater widening of the back 3, this with continued further use of the quite long insertable tongue 4. Also folded open in all representations of FIGS. 12 to 19 are the respectively adjoining tuck-in walls 10 and respectively 18.

Figure 9:
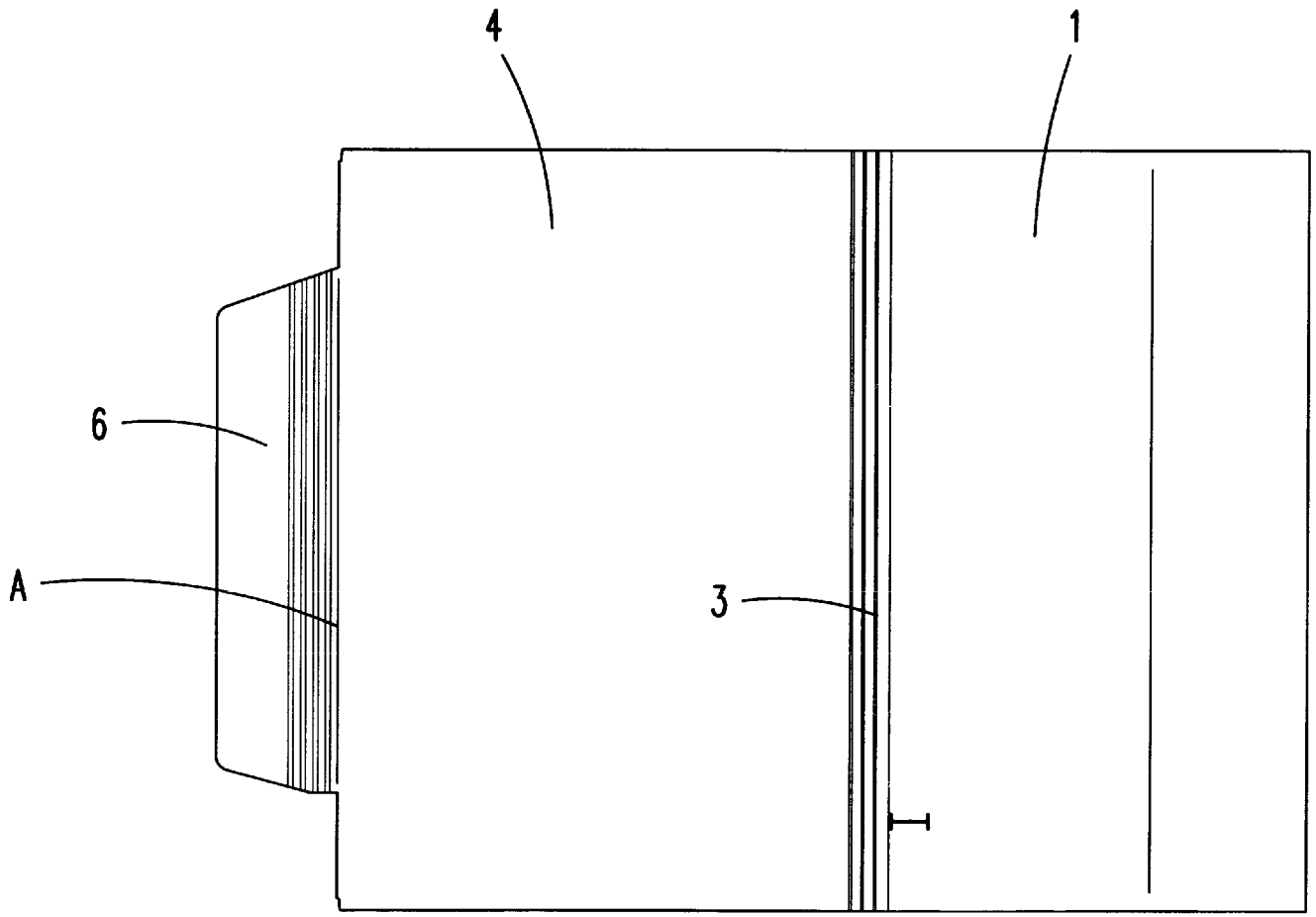
Figure 14:
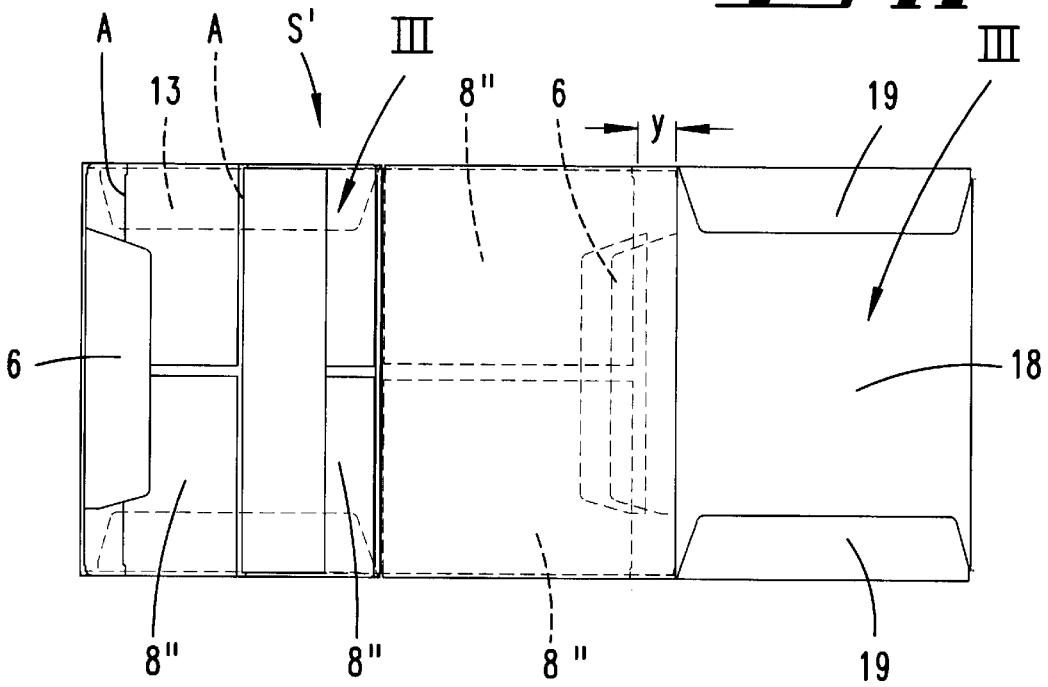
Figure 15:
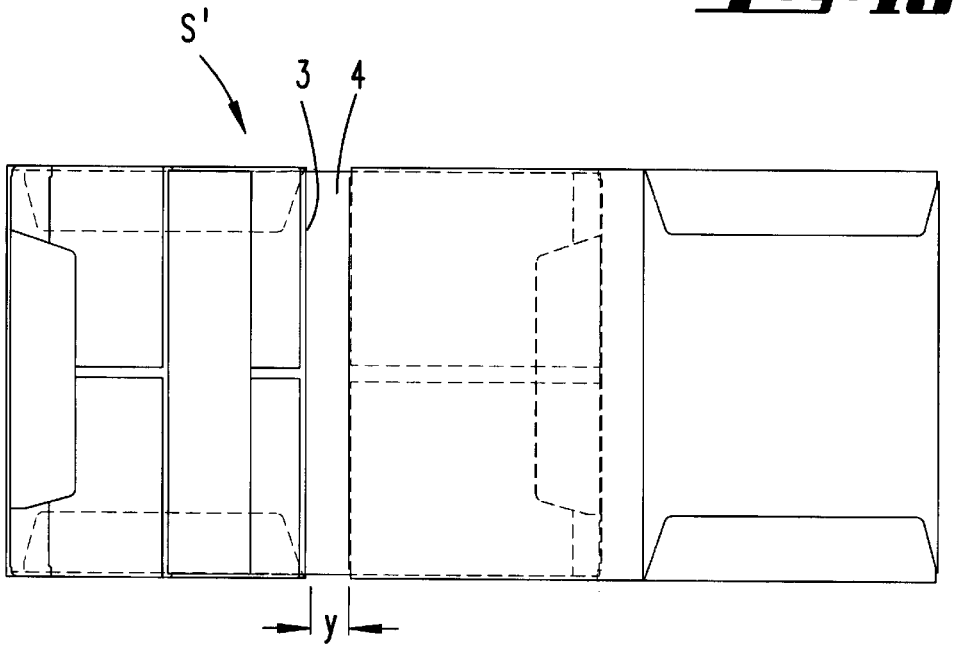
Figure 16:
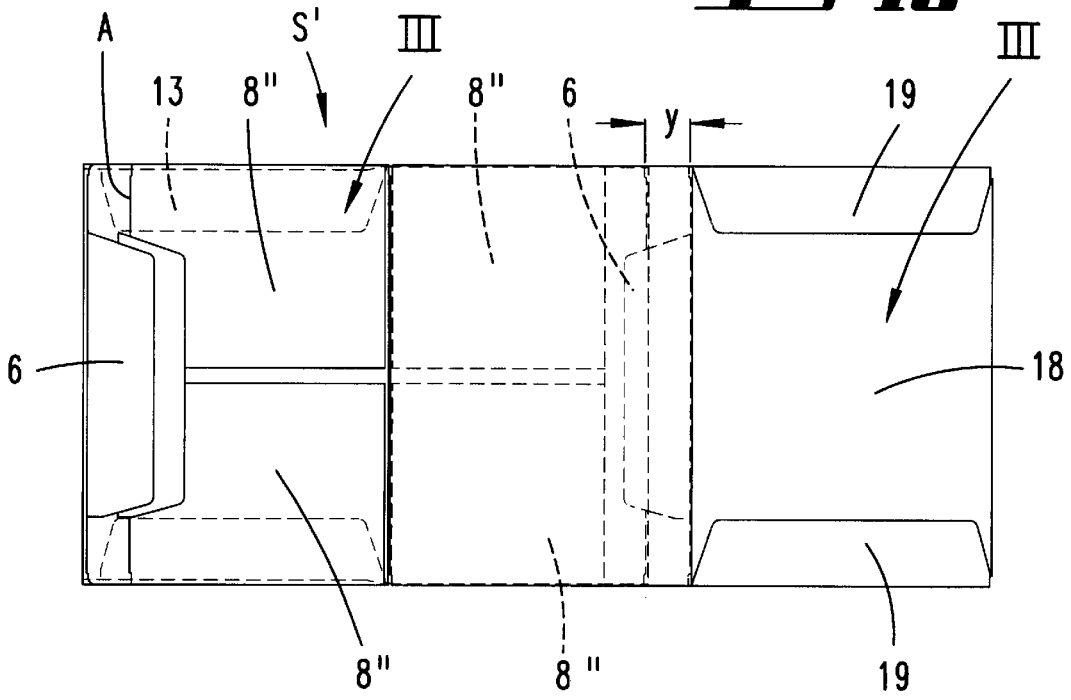
Figure 17:
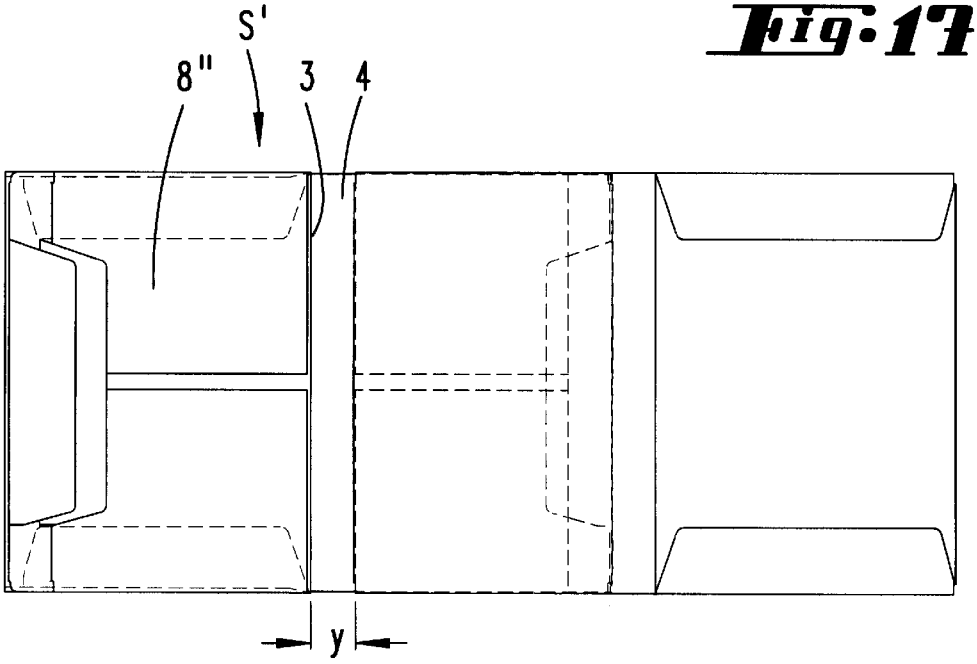
Figure 18:
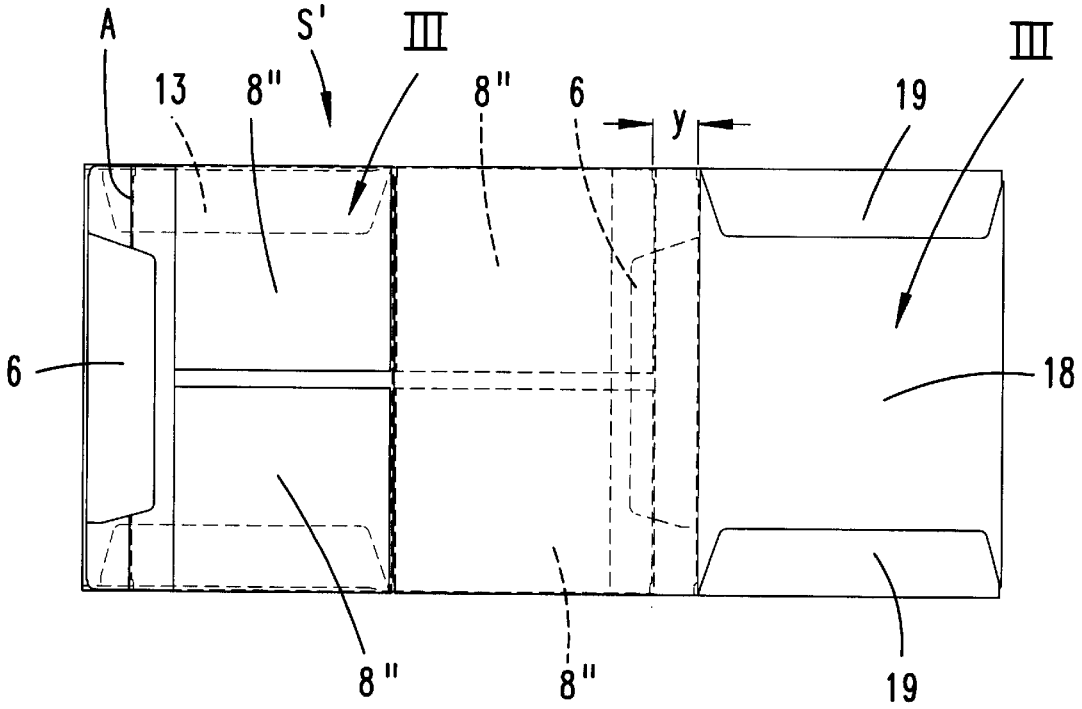
Figure 19:
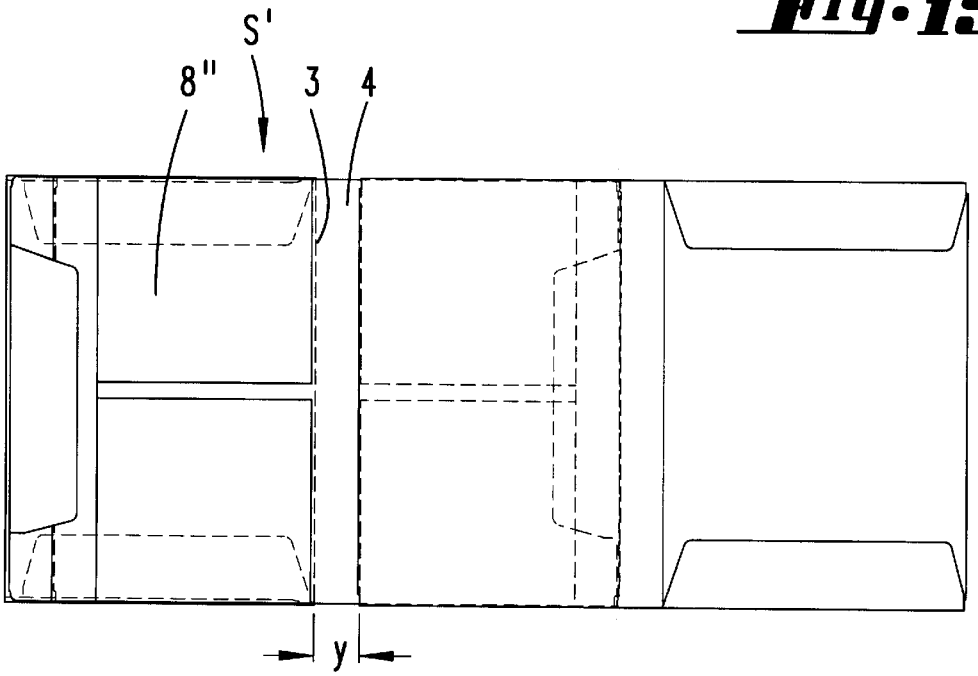
Figure 20:
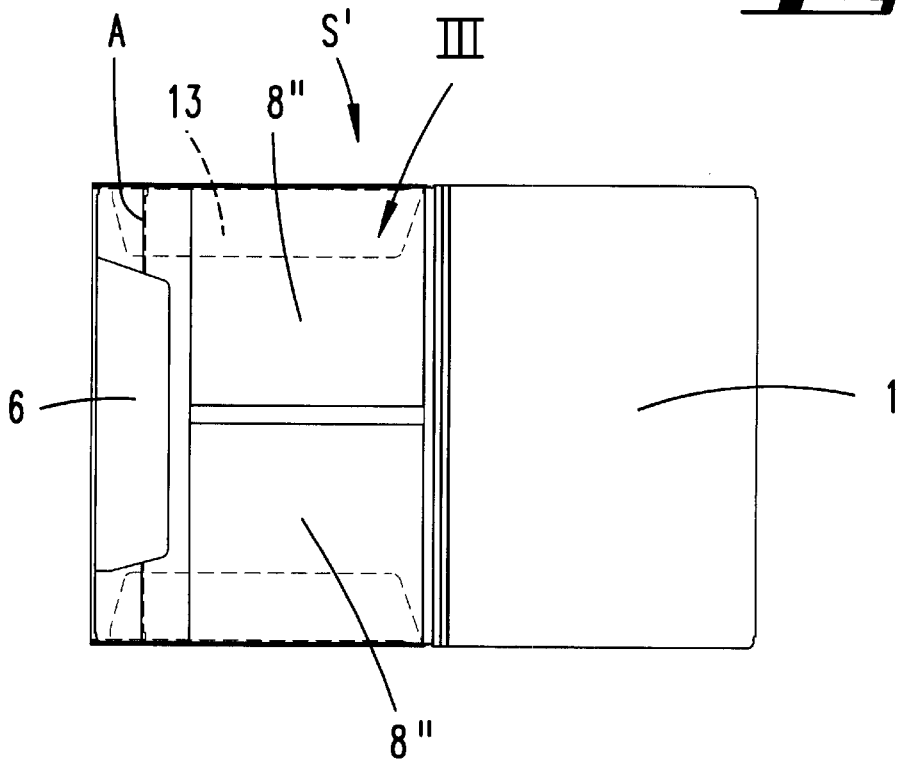

FIG. 14 shows the position of both part folding tabs 8", 8", each forming a stop A, the element disposed closer to the back 3, for hooking, being correspondingly adapted, as to its flap portion, with regard to length and respectively to plan. This element emerges from FIG. 9.

In this embodiment, the tongue-type anchorage explained above may also be resorted to, furthermore in the sense of a slip-case which holds the parts together.

What is claimed is:

1. A folder for papers (S), comprising a cover (1) and a base (2) operatively joined together by a back (3), wherein the back (3) is adjustable in width (y) to accommodate a height of a stack of papers, wherein the back (3) extends on a base side into a tongue (4), said tongue being insertable and movable in a pocket (5), said tongue constituting an insertable tongue, said pocket being joined to the base (2), and movement of the insertable tongue (4) in the pocket (5) being limited by a stop.

2. A folder for papers according to claim 1 wherein the insertable tongue (4) has a flap portion (6) forming the stop (A).

3. A folder for papers according to claim 1, wherein the pocket (5) is formed from a folding tab (8) joined to said base (2).

4. A folder for papers according to claim 1, wherein the pocket (5) is formed from two oppositely directed folding tabs (8) joined to said base (2).

5. A folder for papers according to claim 1, wherein the base (2), continues in a direction away from the back into a tuck-in wall (10) entirely or partially overlapping the pocket (5).

6. A folder according to claim 1, wherein the folder is a multi-compartment folder for papers (S'), further comprising a plurality of stacked folders for papers (S) which are joined mutually displaceable to a limited extent in only one direction.

7. A folder for papers according to claim 2, wherein the flap portion (6) overlaps a top side of the pocket (5).

8. A folder for papers according to claim 2, wherein the flap portion (6) is fold-over for changing a length.

9. A folder for papers according to claim 2, wherein said flap portion has a plurality of fold places and is folded over said pocket at a selected one of said fold places defining said stop and a corresponding selected adjustable width of said back.

10. A folder for papers according to claim 2, wherein the flap portion (6) is selectively foldable-over for changing a length of movement of the tongue in the pocket.

11. A folder for papers according to claim 4, wherein a thin edge of the folding tabs (8), facing away from the back, cooperates as a counter-stop (G) with said stop formed by the flap portion (6).

12. A folder for papers according to claim 4, wherein the folding tab (8) is longitudinally divided, with formation of part folding tabs (8', 8'), for changing a counterstop (G).

13. A folder for papers (S') according to claim 6, further comprising a pocket (5') respectively joining, with limited displacement, the base (2) of a first folder for papers (S) and the cover (1) of a second folder for papers (S), etc.

14. A folder for papers (S') according to claim 13, wherein the pocket (5') is formed as a connecting portion from an intermediate blank (III) having the folding tab or respectively folding tabs (8", 8") and the covers (1) and bases (2) respectively bound to one another by the pocket (5') have flap portions (15 and 16 respectively).

15. A folder for papers (S') according to claim 12, wherein the intermediate blank (III) has a tuck-in wall (18) extending beyond a base (17) thereof.

16. A folder for papers (S') according to claim 15, wherein the tuck-in wail (18) has folding supporting strips (19) transverse to a path of displacement (x) of the tongue (4).

17. A folder for papers, comprising a first member comprising a base having a pocket, a second member comprising a cover, a tongue, and a foldable back joined to said cover and to said tongue, said tongue of said second member being insertable in said pocket of said first member and movable therein so as to operatively expose from said pocket different widths of said back for accomodating different quantities of papers, and a stop limiting movement of said tongue in said pocket.

18. A folder for papers according to claim 17, wherein said stop is a fold of a flap portion connected to said tongue, said flap portion being folded over said pocket by said fold.

19. A folder for papers according to claim 18, wherein said stop cooperates with an edge of said pocket.

* * * * *